United States Patent [19]

Kelly

[11] 4,194,634

[45] Mar. 25, 1980

[54] METHOD AND APPARATUS FOR SORTING RADIOACTIVE MATERIAL

[76] Inventor: Leonard Kelly, 3 Oakwood Rd., Peterborough, Ontario, Canada, K9J 1N2

[21] Appl. No.: 859,195

[22] Filed: Dec. 9, 1977

[51] Int. Cl.[2] ..... B07C 5/346

[52] U.S. Cl. ..... 209/589; 209/576; 209/606; 209/698; 209/914; 250/253; 250/358 R

[58] Field of Search ..... 209/576, 589, 606, 698, 209/914, 922, 586; 250/253, 255, 358 R, 395

[56] References Cited

U.S. PATENT DOCUMENTS

| | | | |
|---|---|---|---|
| 2,996,186 | 8/1961 | Loughran | 209/576 |
| 3,237,765 | 3/1966 | Gaudin et al. | 209/589 |
| 4,021,669 | 5/1977 | Valentine et al. | 209/589 X |

*Primary Examiner*—Joseph J. Rolla

*Attorney, Agent, or Firm*—Roylance, Abrams, Berdo & Farley

[57] ABSTRACT

A method of and apparatus for sorting pieces or particles of radioactive ore where the particles are moved through the apparatus in an asynchronous or non-constant manner. The particles are moved one at a time to a position in front of a radiation detector where they are temporarily stopped. The counts from the particle are accumulated with respect to time. In a control unit of the apparatus there is data representing a cut-off grade radiation rate and earlyupper and lower decision limits are established with regard to the cut-off rate. As soon as the accumulated count/time ratio from the detector exceeds the upper limmit or falls below the lower limit, the control unit is able to provide a decision to accept or reject the particle. If the particles are not closely sized then the size of each particle is determined before it is positioned in front of the radiation detector and the size determination is used to modify the cut-off grade and upper and lower early decision limits. Particles which are well above cut-off or well below cut-off (i.e. above the upper early decision limit or below the lower early decision limit) are disposed of very quickly. Those particles having a value close to cut-off assessed for a longer time. A maximum assessment time is determined for the ore and accuracy required. Because the particles may be assessed for only a short interval, the throughput is increased considerably over prior art arrangements where the feed rate is synchronous or constant and the rate of feed is set for assessment of the smallest and most difficult particles handled.

15 Claims, 9 Drawing Figures

METHOD AND APPARATUS FOR SORTING RADIOACTIVE MATERIAL

BACKGROUND OF THE INVENTION

This invention relates to a method of and apparatus for sorting radiation emissive material, and in particular it relates to a method of and apparatus for sorting radioactive particles of ore.

In the following description reference to the property of radioactivity is intended to include natural radioactivity such as is associated with uranium ore for example, and radioactivity induced by excitation with, for example, neutrons, gamma rays or x-rays. For convenience the description will pertain mainly to the sorting of ore particles containing $U_3O_8$ but it is intended that the invention be directed to the sorting of any ore which has natural or induced radioactive properties.

In the sorting of radioactive ores, each piece or particle may contain a certain amount of radioactive material such as $U_3O_8$. In other words each particle has a definite grade or assay value, and a representative sample of pieces will exhibit a range of grades typical of the value distribution of the particular ore deposit. Knowing the price of uranium, the cost of further milling, and other secondary factors, a "cut-off" grade may be established which represents a lower limit of profitability at that point in the milling process. Particles below this cut-off grade may be profitably discarded. This is the economic basis of sorting. It is, of course, desirable to discard particles below cut-off grade early in the milling process.

The cut-off grade is a ratio or percentage, that is it is an absolute value of $U_3O_8$ related to mass. All cut-off grade particles will have absolute values of contained $U_3O_8$ related to mass and gamma activity is related to the absolute value of $U_3O_8$. For example, ignoring self-shielding within the rock, detector geometry and other secondary factors, the detected radioactivity or "gamma count rate" from 1 inch, 2 inch and 3 inch cubes of identical grade material would be approximately in the proportion of 1:8:27. Therefore it is important to take mass or size into consideration as well as the gamma count rate. This has been done in the past (a) by screening the particles to have them within a certain size range, (b) by measuring the mass such as by weighing, or (c) by determining mass from a size measurement such as might be found by scanning the material to obtain a projected area either in one plane or two different planes and using the scanned areas to estimate mass.

Canadian Pat. No. 467 482 to Lapointe, issued Aug. 22, 1950 describes an apparatus for sorting ore particles where the particles are sized and then proceed in single line arrangement past the radiation detector. This is an example of sorting apparatus referred to in the preceding paragraph under (a). The suggested speed of the particles for a size range of 8 to 15 mm diameter is about 3 to 10 m per minute. This is a relatively slow speed. Furthermore, this broad size range would not give accurate results compared to individually ascertaining the particle size.

U.S. Pat. No. 3,052,353 to Pritchett, issued Sept. 4, 1962, describes an ore sorting device which may determine the mass of each ore particle, as referred to in (b) above, by passing the ore over a form of weighing device. This patent also describes means for determining mass from a projected area as referred to in (c) above.

The ore particles move in a single line, one by one, past a radiation detector.

In the prior art sorting devices it is necessary to have each particle in the immediate vicinity of a radiation detector for a sufficient length of time to obtain a reliable "count" (i.e. a measurement of radiation). A radiation detector, for example a scintillation counter for gamma detection, may be gated on for a predetermined fixed period of time as each particle is immediately adjacent during its passage past the scintillation counter. The fixed period of time is usually related to rock length and the speed of the particle past it. However, because radiation is a random phenomenon, the count may not be representative if the fixed period of the gate is short. Consequently it has been the practice to obtain a more representative count and a more accurate measurement of radiation, by having a longer period when the scintillation counter is gated on. This means the particles must move slowly. In addition, for the same detector arrangement, it takes longer to assess a small particle than a large particle. This is because the radiation will be less and the count will consequently accumulate more slowly. The rate of movement of the particles must be related to the determination of the "cut-off" count for the smallest particles being sorted. This has a drastic effect on throughput and has limited the commercial application of radiometric sorting apparatus.

It should be noted that sorting of most uranium ores may not be an economic proposition if the sorting apparatus can handle only larger size ranges. Furthermore discarding of large particles may discard too great an amount of useful ore. If it were broken into smaller particles, many might be above cut-off grade and be economically processed.

Thus, while it is desirable to sort radioactive ore particles of smaller sizes, it is difficult because it takes longer to accumulate a count of significance, and consequently slows the sorting rate. In addition it is difficult to control background radiation in a uranium mill environment and with smaller particles the count becomes closer to the background count.

Attempts have been made to overcome or reduce the difficulties of sorting small particles or radioactive ore. These attempts generally fall into three groups as follows:

1. Increasing detector size.
2. Using opposed detectors.
3. Using multiple detectors.

It is perhaps self-evident that an increase in the size of the detector will accumulate a count more rapidly and consequently permit a faster throughput. There is, however, a limit to the size that is effective. For example, there is an optimum crystal size and geometry for a scintillation detector for a given particle size and increasing size beyond this produces diminishing returns on the count rate, but background count increases in proportion to crystal volume. In addition, interference from radiation of adjacent particles in the line becomes more of a problem so more space must be left between pieces. The cost of crystals also increases very rapidly with volume.

The use of opposing detectors can significantly increase count rate if the particles are closely sized. However, the general run of particles is frequently found with varying heights and widths and the opposing detectors must be separated by a sufficient distance to avoid jams. Because of the varying distance from at least one detector, there may be a variable introduced. If, however, the particles are closely sized the use of opposing detectors is satisfactory.

Multiple radiation detectors are another arrangement that has been tried, and it permits a faster particle speed and increased throughput. Several detectors are placed in series and the count for a particle is detected as the particle passes each detector and the counts are placed in an accumulator. This is in effect the equivalent of slower movement past a single detector. U.S. Pat. No. 2,717,693 to Holmes, issued Sept. 13, 1955 describes such a multiple detector system. While the use of a multiple detector arrangement increases permissible particle speed, it has on the other hand some disadvantages. For example, shielding and particle separation are more difficult to achieve in a fast feed, series detector configuration. Scintillation detectors in series must be matched or compensated and failure of one will affect the whole series. As with any constant feed rate system, counts are accumulated while the particle approaches and then leaves the optimum detection position, the count is decreased but the background count is not, and hence the ratio of count to background is degraded. Also, as speed increases rocks or particles are more difficult to control and rolling will cause invalid results. In summary, it has been said that six separate slow feed sorters with single detectors may give better results than a fast feed sorter with six series detectors, and breakdowns will be less critical.

SUMMARY OF THE INVENTION

The present invention overcomes disadvantages of prior art radiometric sorters. The prior art sorters of all types have a constant feed rate whether it is a fast rate of feed or a slow rate of feed. The constant feed rate is related to the smallest size and minimum count that can be satisfactorily handled. The present invention makes use of a variable speed rate which will accomodate itself to a variety of sizes of particles.

It is important to realize that if a constant rate of feed, or transit rate, and the number of detectors, is designed to give an adequate count rate to assess a low cut-off on a small particle, then every larger particle and every higher grade particle will be over-analysed. Many high grade particles of a large size may produce enough counts for an "accept" decision before they are half way past the first detector in a series of detectors. Thus the remaining time is not utilized to any purpose. If it could be disposed of at that time and another particle introduced, efficiency would be increased.

Thus, it is an object of the present invention to provide an improved method for sorting radioactive particles by retaining the particles in front of a radiation detector for a length of time that is variable within limits according to particle characteristics.

It is another object of the invention to provide an improved method for sorting radioactive particles by analysing the particles for a length of time related to radiation from the particle.

It is an object of the invention to provide an apparatus for sorting radioactive material more efficiently by assessing each particle for a length of time sufficient to make a decision and then dispose of the particle.

It is yet another object of the invention to provide an apparatus for sorting radioactive particles of material which retains each particle in a fixed position while the particle is analysed.

Accordingly the present invention provides a method for sorting particles of radioactive material which includes the following steps:

(a) moving the particles to be sorted, one at a time, into a predetermined position adjacent a radiation detector, and temporarily retaining the particle in that position for a time period yet to be determined, (b) deriving a first signal from said radiation detector representing radiation from the particle and accumulating it with respect to time, (c) comparing the accumulating first signal with values representing a cut-off rate of radiation and providing a second signal when the first signal exceeds the values by a first predetermined amount and a third signal when the first signal is less than the values by a predetermined amount, and (d) moving the particle from its temporary position along a first path as soon as a second signal is provided and along a second path as soon as said third signal is provided.

Also according to the present invention there is provided apparatus for sorting particles of radioactive material which has a radiation detector and means for moving the particles one at a time into a predetermined stationary position in front of the radiation detector. The apparatus has a means for determining a ratio of radiation with respect to time which defines between acceptable and non-acceptable particles and an upper early decision limit and lower early decision limit a predetermined amount above and below said ratio respectively and converging with the ratio at a maximum comparison time. A comparison means receives a first signal from the radiation detector representing radiation from a particle in front of the detector and accumulates the signal with respect to time and represents the accumulation by a second signal, and then compares the second signal with the upper and lower limits at time intervals spaced apart over the maximum comparison time. A gate means is responsive, at the first occurring one of the time intervals where the second signal is above the upper limit or below the lower limit to move the particle into one of a respective accept path and rejection path.

BRIEF DESCRIPTION OF THE DRAWINGS

The invention will be described in more detail with reference to the accompanying drawings, in which.

DETAILED DESCRIPTION

Figure 1:
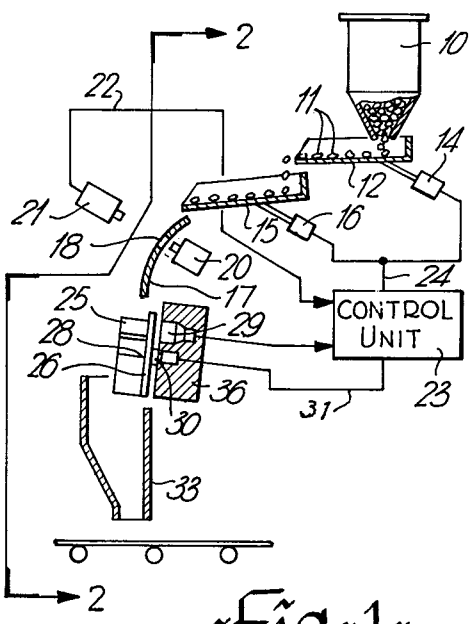
FIG. 1 is a schematic side view of apparatus according to one form of the invention.
Figure 2:
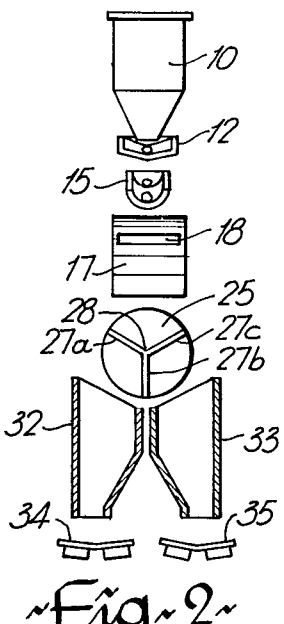
FIG. 2 is a schematic front view of the apparatus of FIG. 1, FIGS. 3 (A), (B) and (C) are views of the gate mechanism of FIGS. 1 and 2, shown in three positions.

Referring now to FIGS. 1 and 2, there is shown a side view and a front view of a radiometric sorting apparatus suitable for sorting a non-uniform feed. As used herein the term "non-uniform feed" is not intended to mean a feed where the particles or pieces of rock can be of widely different sizes. Rather the term "non-uniform feed" is intended to mean that the particles constituting the feed need not be screened to sizes that are closely similar but may be over a reasonable range as there is a determination of size made by the apparatus. This is distinct from sorting apparatus which requires sufficient screening to provide particles for the feed that are of reasonable "uniform" mass whereby size need not be determined and this lack will still provide acceptable accuracy.

A bin 10 holds particles or pieces of ore 11 which are fed out the bottom onto a table 12 of a vibrating feeder driven by motor 14. The use of vibrating type feeders to provide a feed for ore sorting apparatus is well known. The aforementioned Canadian Pat. No. 467 482 to Lapointe shows a vibrating feeder to provide a feed of rock particles. In the apparatus of FIGS. 1 and 2 the particles 11 fall from the edge of table 12 onto a second table 15 driven by a motor 16. The second table 15 is at a slightly greater slope to aid in forming the particles 11 into a single line feed. It is possible to provide an adequate single line feed with only one vibrating table, but the use of two tables, with the second at a slightly greater slope, tends to eliminate any bunching and is preferred. The particles 11 fall off the edge of table 15 one at a time. As a particle 11 falls it accelerates under gravity along a slide plate 17 which provides a smooth trajectory shielded from the vibrations of the feeder lip. The particle 11 passes a window or translucent portion 18 in slide plate 17. A light 20 on one side of the slide plate illuminates translucent portion 18, and a photodetector 21 receives light on the opposite side. The passage of a particle 11 past window 18 occults the light received by photodetector 21 and the photodetector 21 provides a signal on conductor 22 representing (a) the passage of a particle and (b) the projected area or size of the particle. Conductor 22 is connected to a control unit 23 which, on receipt of a signal indicating passage of a particle 11, interrupts power to motors 14 and 16. The motor driving power is applied over conductor 24. This temporarily stops the feed and prevents further flow of particles 11.

Figure 3:
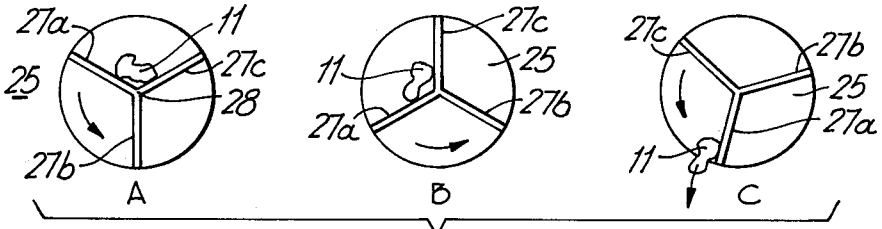

The particle 11 continues along slide plate 17 and falls onto a gate 25. Gate 25 is best described with reference to FIGS. 1, 2 and 3. It comprises a back plate 26 in the form of a disc, with three vanes 27*a*, 27*b* and 27*c* spaced about 120 degrees apart, as shown, and secured to the face of back plate 26 to form three open compartments. When gate 25 is stationary, one compartment is always facing upwards to receive a particle 11. Preferably vanes 27*a*, *b* and *c* are constructed of or covered by a wear resistant material such as urethane. Gate 25 holds a particle 11 in the upper compartment in an optimum position in front of a radiation detector 29 which is housed in lead shielding 36. The gate 25 may be rotated in either direction about a central axis 28, by a motor 30, for example a stepping motor, under control of control unit 23. Control unit 23 is connected to motor 30 by conductor 31. The motor rotates gate 25 to the left or right, depending on whether the particle is to be accepted or rejected, to discharge the particle 11 in the upper compartment into either chute 32 or 33. The particle falls on to the respective one of belts 34 or 35 which carries it away. FIGS. 3(A), (B) and (C) show positions of gate 25 as it rotates to the left to discharge a particle 11. The operation of the apparatus of FIGS. 1 and 2 will now be described in general terms. Suitable circuitry will be described in connection with FIG. 9. With motors 14 and 16 operating, a particle 11 falls from the lip of table. As the particle passes the window 18 it occults light being received by photodetector 21. Photodetector 21 provides a signal via conductor 22 indicating passage of a particle 11. Control unit 23 receives this signal and stops the motors 14 and 16 temporarily to prevent another particle being discharged. Control unit 23 also initiates a short time delay as the particle accelerates under gravity, and the delay permits the particle to travel to the upper compartment of gate 25. Just as the particle is stopped by gate 25, the delay times out and the radiation detector or gamma counter 29 is gated on and begins to count. The counts are passed to the control unit 23. It will be recalled that a signal representing projected area or size was also available at control unit 23 from photodetector 21. The control unit 23 thus has an input representing accumulated counts and a signal representing size. The control unit 23 also has a signal in a memory representing background radiation count rate. This background count signal may be derived by automatically stopping the feed periodically and determining a background count rate. While this background count rate is a regular rate and actual background counts are random, the average compensation will be correct.

The control unit 23 subtracts the background count from the detected count for the particle at a regular rate. That is, as the counts from the scintillation detector 29 are received and accumulated, there is a continuous subtraction of counts (or a subtraction at regular short intervals which is equivalent) representing the average background count rate. This build up or accumulation of net counts is assessed with respect to time for that rock size. This assessment will be described in more detail hereinafter. As soon as the control unit 23 can determine that the particle should be accepted or rejected, and this may be done very quickly for particles with a count a certain amount above cut-off or a certain amount below cut-off, it provides a signal via conductor 31 to motor 30 causing gate 25 to rotate 120 degrees to the left, for example, to cause the particle to fall through chute 32 as a waste particle or to the right to cause the particle to fall through chute 33 as an accepted particle of ore. The control unit 23, at the same time switches motors 14 and 16 on to move another particle off table 15 and the assessment of that particle is initiated.

It will, of course, be apparent that the size of a particle can be determined and the passage of a particle can be detected by means other than a light source and light detector on opposite sides of the path followed by the particles. For example a scanning device placed adjacent to the particle path can determine size and detect the passage of a particle as is known in the art.

It will also be apparent that if the size of the particles can be restricted to a small range, i.e. if the feed particles can be "uniform", there is no need for any means to determine size. An average size is used by the control unit in assessing each particle.

Figure 4:
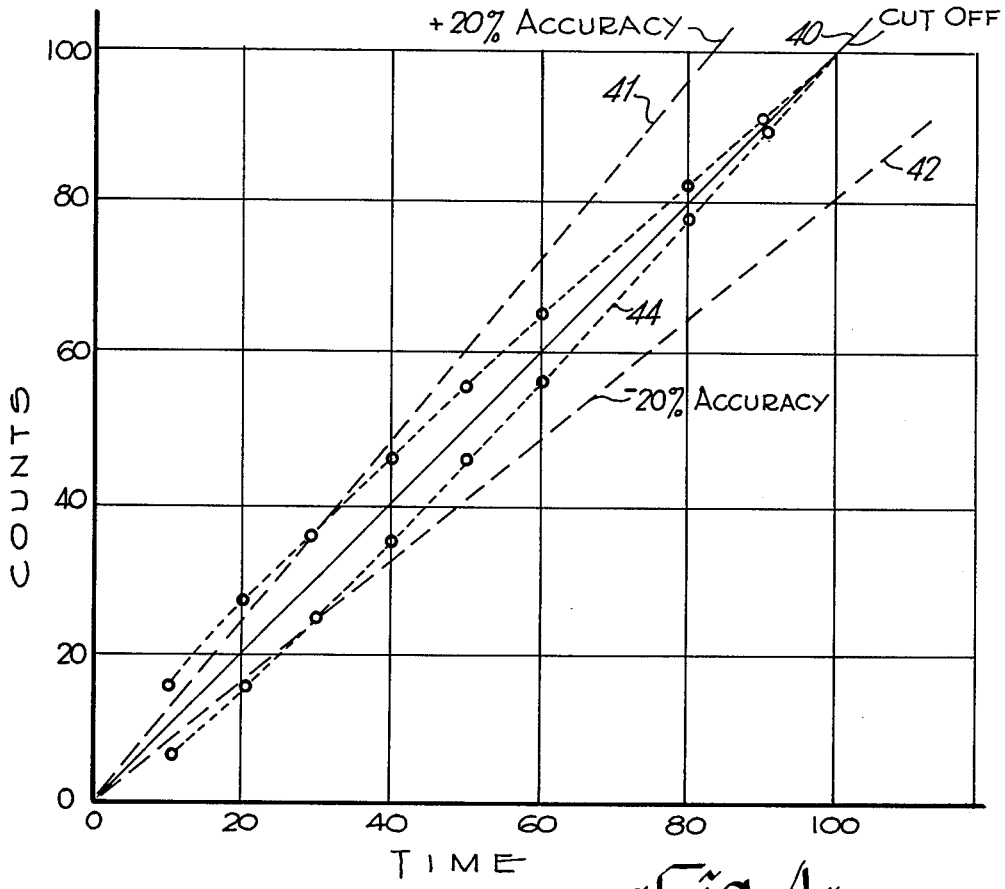
FIG. 4 is a graph of radiation counts vs. time, useful in explaining the operation of the invention.

Referring now to FIG. 4, there is shown a graph with counts plotted against time. This graph is useful in explaining the accept/reject assessment. It may be determined, from experimental data, what average net count rate may be expected from a cut-off grade particle or piece of ore using a particular detector and geometry. This average net count rate can be adjusted for size, however for the time being we can consider a uniform particle size with a constant rate. The accuracy of the sorting or assessment is determined by the total counts, that is, by increasing the number of counts on which a decision is based the accuracy can be increased. If the cut-off count rate is known, then it follows that a maximum count time is calculable which will ensure a specified accuracy on cut-off grade particles.

As an illustration, and by way of example, suppose a cut-off grade is 0.01% $U_3O_8$ and a standard or uniform size piece gives 1000 net counts per second. Thus a count time of 100 milliseconds will give an average 100 net counts on a cut-off piece. This is shown in FIG. 4 where solid line 40 represents the cut-off count rate. Suppose the accuracy requirement is 95% within ±20% at this cut-off. The standard deviation is $\sqrt{100}=10$, and 95% of 100 millisecond counts on a cut-off piece will fall between 80 and 120 counts, equivalent to the 95% with ±20% as required. So 100 milliseconds is the maximum time needed to assure this accuracy. Looked at another way, a count of 100 gammas in 100 milliseconds will mean the grade of the particle is between 0.008 and 0.012% at the 95% confidence level. The dashed lines 41 and 42 on the graph represent the ±20% and −20% accuracy limits respectively.

It should be noted here that (1) particles which are sufficiently higher than cut-off grade will produce enough counts quite quickly and they may be assessed as ore before the maximum time (100 milliseconds in this example) has expired, and (2) particles which are sufficiently below cut-off grade will produce so few counts that they may be assessed as waste before the maximum time has expired.

It is, of course, necessary to have a basis for making an early assessment of a particle as being ore or waste. At the maximum time of 100 milliseconds (in the example used), if there has been no decision, one must be made and the decision point is 100 counts. Anything at least slightly above is ore and anything slightly below is waste and the accuracy will be ±20%. However limits must be established at other points. One convenient way of doing this, as an example, is to take the mid-point of the graph of FIG. 4, i.e. 50 counts in 50 milliseconds. The ±20% accuracy requirements at 50 milliseconds would be 60 and 40 counts. The upper early decision point is therefore set at count $Y_1$ which has a probability distribution 95%>40. This gives an equation $$Y_1-2.\sqrt{Y_1}=40 \quad (1)$$

Solving equation (1) gives $Y_1=54.8$

Similarly the lower early decision point $Y_2$ at 50 milliseconds would give an equation $$Y_2+2.\sqrt{Y_2}=60 \quad (2)$$

Solving equation (2) gives $Y_2=46.4$

Rounding off $Y_1$ and $Y_2$ to 55 and 46 respectively establishes the counts for early decision at 50 milliseconds. In other words, any particle having more than 55 counts in 50 milliseconds should be taken for ore at once, and any particle having less than 46 counts in 50 milliseconds should go for waste.

If points are plotted, starting from an arbitrary minimum time of 10 milliseconds, according to equations (1) and (2) then relationships represented by dotted lines 43 and 44 can be established. Line 43 represents the upper early decision limit and line 44 the lower early decision limit. Thus, as soon as the time of accumulation of net counts passes the minimum 10 milliseconds an assessment can be made. If the count goes above the count/time relationship represented by line 43 the particle being assessed is accepted as ore, and if the count goes below the count/time relationship of line 44 the particle is rejected as waste. The only particles that are held for assessment for the full 100 milliseconds are those whose count rate remains between that represented by lines 43 and 44. In this example, such a particle would produce 100 gammas in 100 milliseconds and the 95% confidence levels will be $100\pm2\sqrt{100}$ which is 80 and 120. This is the required accuracy.

The example used above, including the figures of 95% probability, 20% accuracy level, and arbitrary limits, is used only as illustrative. In practice the figures and limits are tailored to the particular ore and particular requirements.

The above example was for a uniform feed. When a non-uniform feed is used, size must be considered as was referred to in connection with the apparatus of FIGS. 1 and 2. The cut-off net count rate will vary with particle size as will other factors and control unit 23 adjusts the various relationships accordingly.

In the apparatus described in connection with FIGS. 1 and 2 the vibrating feeder is shut off temporarily to interrupt the feed each time a particle falls into the gate for assessment and is started again when the particle is accepted or rejected and is tripped from the gate. As the time or duration of a particle in front of the radiation counter is not known, the vibrating feeder cannot be started until a decision is made. The gate can then operate. The gate mechanism is relatively fast acting and it takes only a few milliseconds to operate. Thus, after a few milliseconds the gate is ready to receive another particle. However the vibrating feeder mechanism is comparatively slow. It may take perhaps 100 to 160 milliseconds to vibrate a particle 2 inches long over the lip. The particle takes perhaps another 200 milliseconds to accelerate from rest and fall 8 inches onto the gate. It will be apparent that throughput could be increased if this time could be reduced. The buffered arrangement of FIGS. 5 and 6 will reduce this time.

Figure 5:
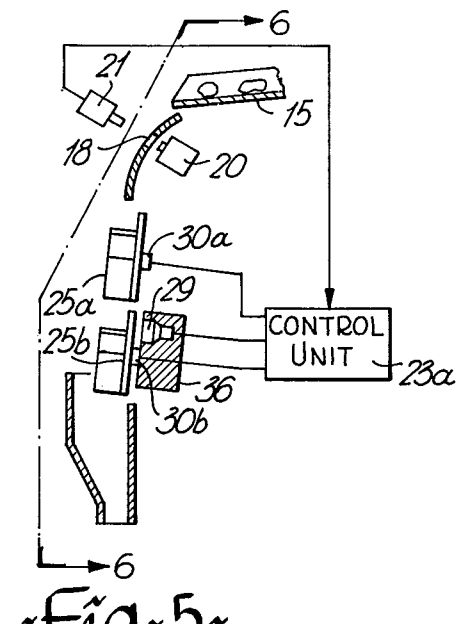
FIG. 5 is a schematic partial side view of apparatus according to another form of the invention.
Figure 6:
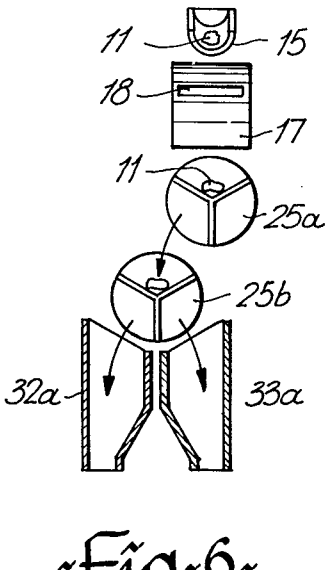
FIG. 6 is a schematic front view of the apparatus of FIG. 5.

Referring now to FIGS. 5 and 6 there is shown a partial side view and a partial front view of a sorting apparatus having a buffered feed. Only part of the vibrating table 15 is shown and other parts may be omitted for simplicity. Below side plate 17 is a gate **25*a* with three vanes, as before. Gate 25*a* rotates in only one direction, i.e. to the left as seen in FIG. 6 driven by motor 30*a*. Below and to one side is gate 25*b* with a radiation detector 29 mounted behind it in a lead shield 36, as before. The gate 25*b* is capable of rotation in either direction by motor 30*b***.

The apparatus of FIGS. 5 and 6 provides a buffered feed. Assume that the apparatus is already operating and therefore there will be a particle in the upper compartment of both gates **25*a* and 25*b*. The particle in the upper compartment of gate 25*b* is being assessed as radiation counts are passed from counter 29 to control unit 23*a* where the counts are compared to a value represented by a relationship as described in connection with FIG. 4, adjusted or compensated for size. As soon as a decision is made that the particle is ore or waste, a signal is applied to motor 30b rotating gate 25b by 120 degrees in the appropriate direction to discharge the particle into the ore chute or the waste chute. At the same time, or with a very small delay, control unit 23a applies a signal to motor 30a rotating gate 25a to the left (as seen in FIG. 6) and the particle in the upwardly facing compartment of gate 25a is discharged into the compartment of gate 25b that has just rotated into the upper position. Also at the same time as the decision is made, control unit 23a energizes the vibrating feeder to move another particle from the vibrating table onto slide plate 17 where it accelerates under gravity down slide plate 17 into the upper compartment of gate 25a. As this particle passes the translucent portion 18 and photodetector 21 a signal representing size is provided for a memory in control unit 23a. The signal also represents passage of a particle which will turn off the vibrating feeder temporarily, unless of course, a decision has been reached with respect to the particle now in the upper compartment of gate 25b**.

It will be apparent that if there are a series of particles which are well above cut-off, their time of assessment will be short and the vibrating feeder will be operating continuously while gate 25b will not be filled as quickly as it should for maximum efficiency. However, if there is a mix of particles the throughput will be higher than with the apparatus of FIGS. 1 and 2.

Figure 8:
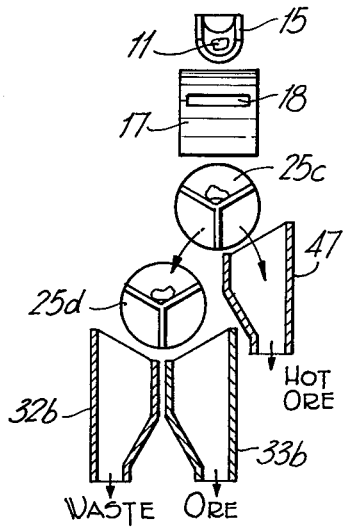
FIG. 8 is a schematic front view of the apparatus of FIG. 7.
Figure 7:
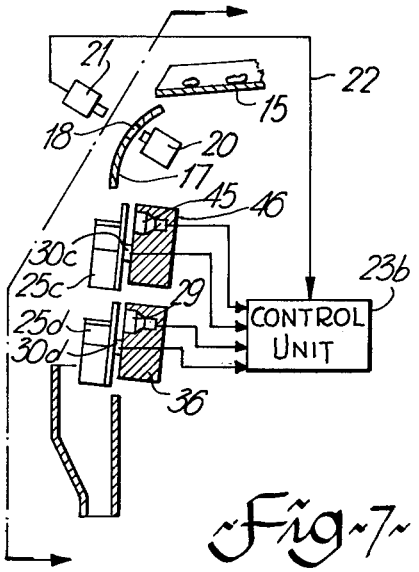
FIG. 7 is a schematic partial side view of apparatus according to another form of the invention.

Referring now to FIGS. 7 and 8 there is shown a partial side and front view of a sorting apparatus having a buffered feed with an auxiliary radiation detector 45 in a lead shield 46. The radiation detector or radiation counter 45 is mounted directly behind gate 25c. The gate 25c is capable of rotation in either direction, driven by motor 30c. The apparatus is otherwise similar to that of FIGS. 5 and 6.

The auxiliary radiation counter 45 provides a count to control unit 23b. The counter 23b begins a count-/time/size assessment (as outlined in connection with FIG. 4) as soon as a particle is received in gate 25c. If the particle in the upper compartment of gate 25d has been assessed and a decision reached, then control unit 23b causes motor 30d to rotate gate 25d by 120 degrees to discharge that particle into chute 33b or 32b as ore or waste according to the assessment. At the same time the particle in the upper compartment of gate 25c is passed to the new upper compartment of gate 25d and its accumulated count/time/size assessment data is transferred by control unit 23b so that the assessment can continue with the count from radiation counter 29. A new particle is, of course, fed into the new upper compartment of gate 25c.

If a particle in gate 25c is sufficiently above cut-off, i.e. of sufficiently high grade, it may be disposed of before the control unit 23b reaches a decision with respect to the particle in gate 25d and causes gate 25d to operate. If so, the control unit 23b causes motor 30c to operate, rotating gate 25c (to the right as seen as FIG. 8) and discharging the particle from gate 25c into chute 47 as "hot" ore or high grade ore. The control unit will then energize the vibrating feeder to introduce a new particle into gate 25c.

It is a feature of the invention that if a very high grade particle or piece of ore is immediately discharged from gate 25c, a correction may be made to the counts being accumulated from radiation counter 29 to compensate for the presence of a particle of high grade ore in the vicinity. The ability to separate and quickly dispose of high grade particles and be able to compensate for radiation interference is an important factor in accurate and efficient sorting. Other sorting equipment having a steady or constant feed must compromise with high grade particles either by providing increased spacing between all particles and decreasing throughput, by accepting the interference at the expense of accuracy, or by raising the cut-off and rejecting some of the otherwise acceptable particles.

In summary, in all the embodiments of the invention described herein, there are several common features:

1. The particle feed is asynchronous, i.e. not regular in time but responsive to the demands of the radiation detector.
2. A particle is accelerated to an efficient detection position, stopped, and held there for a length of time that is not fixed.
3. Counting time or assessment time in front of the radiation detector for each particle is governed by the settings of the control unit and by the particle or piece of rock. Marginal particles will require the longest assessment time up to a predetermined maximum time, but the majority of particles will be definite ore or waste and a decision will be reached quickly.
4. The accept/reject mechanism acts on a precisely positioned stationary particle rather than a particle in motion.

It will be apparent that it is not necessary to use a rotating gate mechanism to accept or reject particles. While such a mechanism is convenient in that it stops and holds a particle as well as accepts or rejects the particle, nevertheless the particle could be moved to an accept or reject path by other means, for example by a blast of air or mechanized plungers pushing the particle in a desired direction.

It was previously mentioned that suitable circuitry would be described for the apparatus of FIGS. 1 and 2. It is believed the description thus far provides an adequate understanding of the invention, and the circuitry of FIG. 9 is given only as an example of suitable circuitry.

Figure 9:
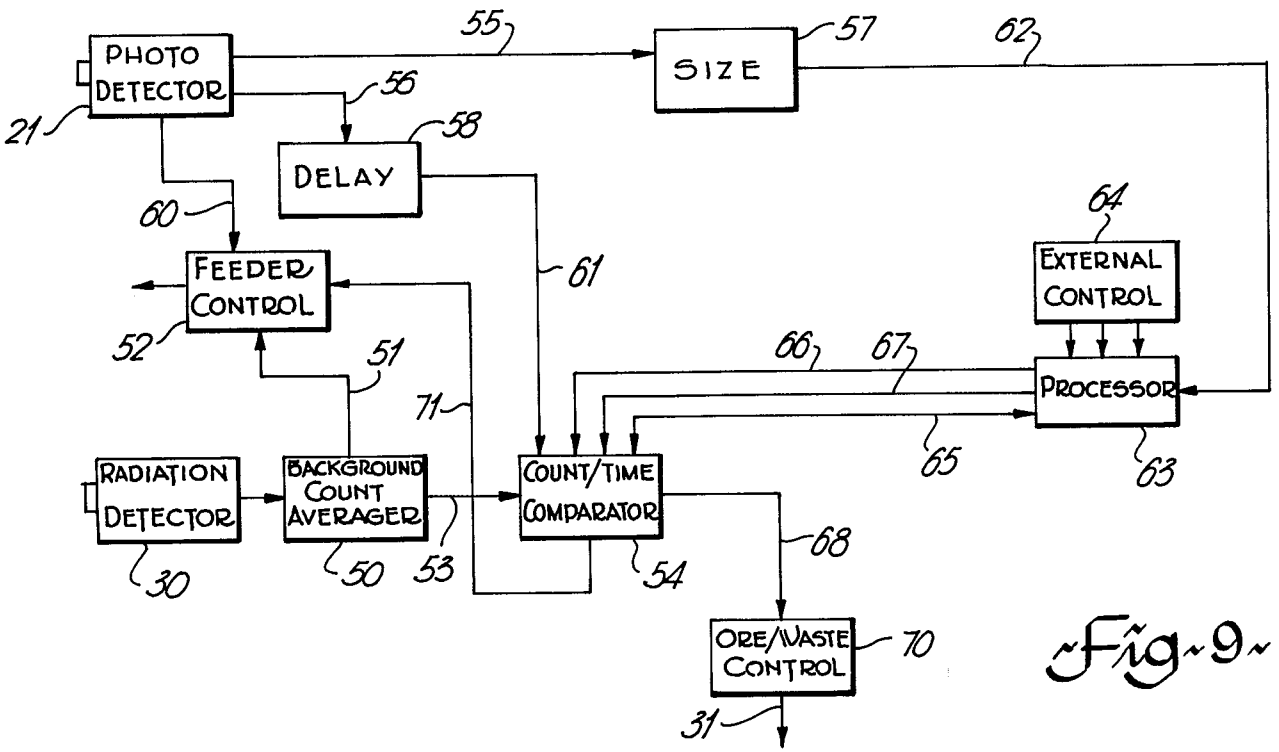
FIG. 9 is a block schematic diagram of one form of the invention.

Referring to FIG. 9, the photodetector 21 and the radiation detector 30 of the apparatus of FIGS. 1 and 2 are shown. The remainder of the circuitry is represented in FIGS. 1 and 2 by the control unit 23. The radiation detector 30, preferably a scintillation detector, produces pulses corresponding to gamma rays received within a required energy range. The pulses are applied to a background count averager 50 which subtracts pulses corresponding to the average background count rate. The background count averager 50 maintains an updated average background count rate by periodically stopping the feeder with an inhibit signal on conductor 51 applied to feeder control 52. The input pulses from scintillation detector 30 during this inhibit interval will provide data for determination of an average background count.

The background count averager 50 provides a signal on conductor 53 to count/time comparator 54. It is the count/time comparator 54 which makes the assessment described in connection with FIG. 4.

When a piece or particle of rock falls from the feeder table it moves downwards past photodetector 21. The output of photodetector 21 is applied via conductors 55 and 56 to a size analyser 57 and a delay 58, respectively, and via conductor 60 to feeder control 52. The signal on conductor 60 stops the feed to avoid having two particles in the gate 25 (FIGS. 1 and 2). The delay 58 provides a short delay, sufficient for the particle or piece of rock to fall into position in gate 25 (FIGS. 1 and 2) and then it provides a signal on conductor 61 to count/time comparator 54 to start it. That is, count/time comparator starts a clock (i.e. pulse type timing device) and a gamma counter.

The size analyser 57 determines size of the particle and provides a size signal on conductor 62 to a processor 63. An external control 64 permits the input of settings representing cut-off, accuracy and probability and these are applied to the processor 63. The processor 63 also receives time signals from count/time comparator 54 via conductor 65. These time signals are at discrete short preset intervals commencing with the start of the count/time comparator 54. During each interval the processor 63 takes into account the external settings from external control 64 and the size signal from size analyser 57 and it calculates an upper and a lower early decision limit (lines 43 and 44 of FIG. 4) for the end of the next time interval. Signals representing these upper and lower limits are applied via conductors 66 and 67 to count/time comparator 54. The comparator 54, at the end of each time interval, temporarily latches the net counts it is accumulating from the backbround count averager 50 and compares it with the upper and lower early decision limits from processor 63 for the particular time. As was previously explained, if the accumulated net counts exceed the upper early decision limit or are below the lower early decision limit a signal is provided on conductor 68 to ore/waste control 70 that the particle is ore or that the particle is waste. If the comparison made by comparator 54 shows that the accumulated net counts is between the upper and lower early decision limits, then the procedure continues. It will be apparent from FIG. 4 that the procedure cannot continue past the predetermined maximum time for comparison because at this maximum time the upper and lower limits converge on the cut-off rate. At the same time that a signal is provided on conductor 68 that the particle in the gate is ore or is waste, a signal is also provided on conductor 71 to feeder control 52 to start the vibrating feeder again. The ore/waste control 70 when it receives a signal that a particular particle is ore or is waste, provides a signal on conductor 31 which causes the gate 25 (FIGS. 1 and 2) to rotate in the required direction to discharge the particle as ore or as waste.

Various alternatives will be apparent to those skilled in the art. For one example, when comparing a signal representing radiation with upper and lower limits as was explained in connection with FIG. 4, it is not necessary to make the comparison at time intervals which are constant. The time intervals may be at increasing or decreasing intervals within the maximum period. Alternately the comparison may be made when the signal reaches a predetermined value and then the time taken for it to reach that value compared to the equivalent time for the upper and lower limits.

It is believed that the operation of the invention in its forms will now be clear.

I claim:

1. A method of sorting particles of radioactive material comprising the steps of moving a particle to be sorted into a predetermined position adjacent a radiation detector, temporarily retaining said particle in said position, comparing a first signal representing rate of radiation provided by said readiation detector with values representing a cut-off rate of radiation and providing a second signal when said first signal exceeds said values by a first predetermined amount and a third signal when said first signal is less than said values by a second predetermined amount, the step of comparing lasting only until one of said second or third signals is provided, and moving said particle in one of a first and a second path responsive to a respective one of said second and third signals.

2. A method as defined in claim 1 in which said detector begins providing said first signal as soon as said particle is in said predetermined position and said step of comparing begins a predetermined short interval thereafter.

3. A method as defined in claim 2 in which said first and second predetermined amounts are variable amounts, decreasing with time to become zero at a maximum interval of time permitted for said step of comparing.

4. Apparatus for sorting particles of radioactive material, comprising a radiation detector, means for moving particles of material one at a time into a predetermined stationary position in front of said radiation detector, first means for determining a ratio of radiation with respect to time which defines between acceptable and non-acceptable particles and an upper early decision limit and lower early decision limit a predetermined amount above and below said ratio respectively and converging with said ratio at a maximum comparison time, comparison means for receiving a first signal from said detector representing radiation from a particle in said position and deriving therefrom a second signal representing an accumulation of said first signal with time, and for receiving from said first means a third signal representing said upper and lower limits, and comparing said second and third signals at time intervals spaced apart over said maximum comparison time, and second means responsive at the first occurring time interval where said second signal is outside the upper and lower limits represented by said third signal to move said particle into one of a respective accept path and rejection path.

5. Apparatus as defined in claim 4 and further including means for providing a fourth signal representing the size of said particle in said position, and providing said fourth signal to said first means for determining a ratio of radiation with respect to time to adjust said ratio in accordance with size.

6. Apparatus as defined in claim 5 in which said radiation detector is a scintillation detector, said counts from said scintillation detector constituting said first signal.

7. Apparatus as defined in claim 5 in which said second means includes a gate which supports said particle and which operates in one of two directions to move said particle into one of said accept path or rejection path.

8. Apparatus for sorting particles of radioactive material, comprising a gate having at least one open compartment, means to arrange said particles in single row alignment and to discharge said particles into said compartment one at a time in response to a first signal, a radiation detector adjacent said compartment and responsive to radiation from the particle therein to provide a second signal representing said radiation, accumulator means for receiving from said radiation detector said second signal and providing a third signal representing said radiation accumulated with respect to time, means having data representing a ratio of radiation with respect to time for a predetermined cut-off grade establishing an upper early decision limit representing values a predetermined amount above said ratio and a lower early decision limit representing values a predetermined amount below said ratio and providing a fourth signal representing said limits, said limits converging with said cut-off grade ratio at a maximum comparison time, comparison means connected to said accumulator means and to said means having data representing a ratio of radiation with respect to time for receiving said third and fourth signals and comparing them at predetermined intervals, said comparison means providing a fifth signal when said third signal is above said upper early decision limit and a sixth signal when said third signal is below said lower early decision limit, means connected to said gate and to said comparison means for operating said gate to discharge the particle in a first path responsive to said fifth signal and to a second path responsive to said sixth signal, said comparison means also providing said first signal following one of said fifth and sixth signals to operate said means to arrange said particles in single row alignment and discharge another particle therefrom into a compartment of said gate.

9. Apparatus as defined in claim 8 and further comprising means for determining the size of the particle discharged into said open compartment and to provide a seventh signal representing the size, and means connected to said means having data representing a ratio of radiation with respect to time to apply thereto said seventh signal for adjusting said ratio and said upper and lower early decision limits according to said seventh signal.

10. Apparatus as defined in claim 9 in which said gate comprises a disc of radiation penetrable material mounted on a central axis for rotation therearound, said disc having on the face thereof at least three equally spaced vanes extending radially from the axis, each pair of adjacent vanes defining an open compartment, said axis being substantially horizontal, said means connected to said gate and to said comparison means including a motor responsive to said fifth signal to rotate said disc in a first direction to discharge a particle in an upper compartment to said first path and responsive to said sixth signal to rotate said disc in a second direction to discharge a particle in an upper compartment to said second path.

11. Apparatus as defined in claim 10 in which there are three vanes defining three compartments and in which the motor rotates the disc by 120 degrees responsive to one of said fifth and sixth signals.

12. Apparatus as defined in claim 9 in which said means for determining size comprises a light source on one side of the path followed by the particle and a photodetector on the other side of said path, passage of a particle between said light source and said photodetector occulting the light received by said detector in accordance with the projected area of said particle giving a representation of size.

13. Apparatus as defined in claim 9 and further including means to determine background radiation at said radiation detector, said means being connected to said accumulator to reduce said third signal in accordance with said background radiation.

14. A method for sorting particles of radioactive ore comprising the steps of moving a particle under the influence of gravity into a retaining gate and temporarily retaining said particle in said gate adjacent a radiation detector, activating said radiation detector as soon as said particle is in said gate to provide a first signal representing radiation from said particle, accumulating said first signal to provide a second signal representing a rate of radiation, determining the size of said particle, comparing said second signal with values representing a cut-off rate of radiation, and providing a third signal when said second signal exceeds said values by a first predetermined amount and a fourth signal when said second signal is less than said values by a predetermined amount, adjusting said values according to the determined size, and discharging said particle from said gate in one of a first path or a second path responsive to a respective one of said third and fourth signal.

15. Apparatus for sorting particles of radioactive material, comprising a first gate having at least one open compartment for holding a particle and being movable to a first discharge position to discharge a particle therefrom along a first path and to a second discharge position to discharge a particle therefrom along a second path, feeder means to arrange said particles in single row alignment and to discharge said particles one at a time into said open compartment of said first gate in response to a first signal, a first radiation detector mounted adjacent said open compartment of said first gate and responsive to radiation from a particle therein to provide a second signal representing said radiation, first accumulator means connected to said first detector for receiving said second signal and providing a third signal representing radiation accumulated with respect to time, a second gate having at least one open compartment for holding a particle and being movable to a first discharge position to discharge a particle therefrom along a third discharge path and a second discharge position to discharge a particle therefrom along a fourth discharge path, said second gate being positioned in said first path to receive particles discharged from said first gate, a second radiation detector mounted adjacent said open compartment of said second gate and responsive to radiation from a particle therein to provide a fourth signal representing said radiation, a second accumulator means connected to said second detector for receiving said fourth signal and providing a fifth signal representing radiation from the particle in the open compartment of said second gate accumulated with respect to time, control means having data representing a ratio of radiation with respect to time for a predetermined cut-off grade establishing an upper early decision limit representing values a predetermined amount above said ratio over a predetermined time period and a lower early decision limit representing values a predetermined amount below said ratio over said predetermined time period and providing a sixth signal representing said limits, said limits converging with said cut-off grade ratio at a maximum assessment time corresponding to the end of said predetermined time period, comparison means connected to said second accumulator means and to said control means for receiving said fifth and sixth signals and comparing said signals at predetermined time intervals within said predetermined time period, said comparison means providing a seventh signal when said fifth signal is above said upper early decision limit and an eighth signal when said fifth signal is below said lower early decision limit, means connecting said comparison means with said second gate for operating said second gate to said first discharge position responsive to said seventh signal and to said second discharge position responsive to said eighth signal, means connecting said comparison means to said first gate for operating said first gate to said first discharge position responsive to either of said seventh and eighth signal and transferring the accumulated count represented by said third signal in said first accumulator means to said second accumulator means for continuing the accumulation count of the particle discharged along said first path into said second gate, said comparison means being connected to said first accumulator means and to said control means for receiving third signal and said sixth signal and comparing said signals at predertermined time intervals, said comparison providing a ninth signal when said third signal is above said upper early decision limit, prior to said seventh or eighth signals initiating movement of said first gate to said first discharge position, and means responsive to said ninth signal operating said first gate to said second discharge position.

* * * * *